United States Patent [19]

Lescure

[11] Patent Number: 4,547,017

[45] Date of Patent: Oct. 15, 1985

[54] ARTICULATED CHAIR

[75] Inventor: Jacques Lescure, Is-sur-Tille, France

[73] Assignee: AMI, Is-sur-Tille, France

[21] Appl. No.: 568,231

[22] PCT Filed: Apr. 27, 1983

[86] PCT No.: PCT/FR83/00078

§ 371 Date: Dec. 23, 1983

§ 102(e) Date: Dec. 23, 1983

[87] PCT Pub. No.: WO83/03957

PCT Pub. Date: Nov. 24, 1983

[30] Foreign Application Priority Data

May 19, 1982 [FR] France ..... 82 08778

[51] Int. Cl.[4] ..... A47C 1/02

[52] U.S. Cl. ..... 297/318; 297/322; 297/329; 297/353

[58] Field of Search ..... 297/317, 318, 316, 322, 297/329, 353, 68

[56] References Cited

U.S. PATENT DOCUMENTS

| | | | |
|---|---|---|---|
| 2,629,425 | 2/1953 | James | 297/317 |
| 2,633,181 | 3/1953 | Bell | 297/317 |
| 3,572,829 | 3/1971 | Malitte | 297/317 |
| 4,251,107 | 2/1981 | Sato | 297/318 |

FOREIGN PATENT DOCUMENTS

| | | | |
|---|---|---|---|
| 599431 | 6/1960 | Canada | 297/317 |
| 1124109 | 10/1956 | France . | |
| 1297900 | 5/1962 | France . | |
| 197538 | 5/1938 | Switzerland | 297/318 |

*Primary Examiner*—James T. McCall

*Attorney, Agent, or Firm*—Young & Thompson

[57] ABSTRACT

A back rest and a chair seat are pivoted to each other about a displaceable axis and the back rest is pivotally attached to a support along an axis parallel to that axis. The back rest and the seat are continuously displaceable with respect to each other between a sitting position and a recumbent position of the user. At least the displacement of the chair seat is guided at the end opposite to the axis of pivotal attachment of the seat to the back rest along a curve so determined that, when the back rest and seat undergo a displacement between the two positions mentioned above, the center of gravity of the user's body moves away from a horizontal plane over a distance which is sufficiently short to ensure that the user can modify the relative position of the back rest and seat by exerting acceptable efforts without any need to rise from the chair.

10 Claims, 18 Drawing Figures

FIG_7
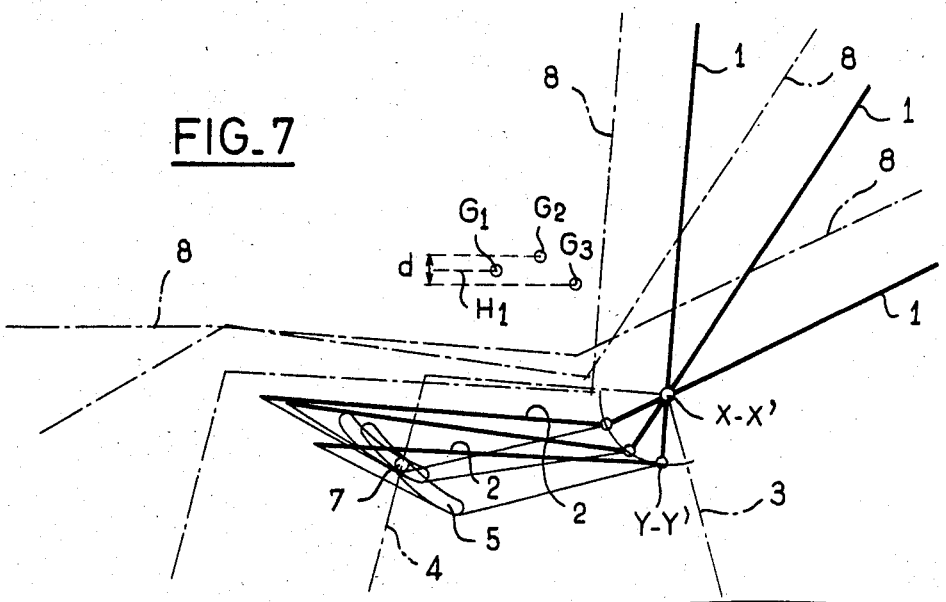
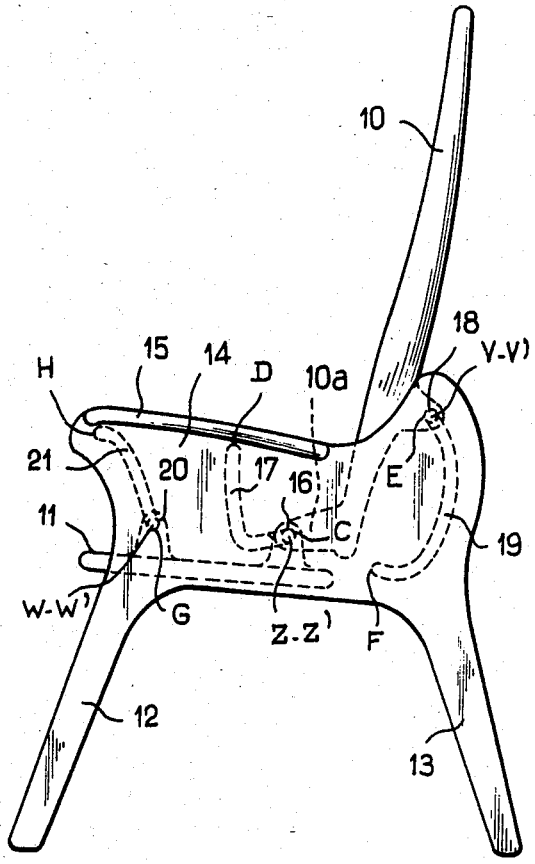
FIG_8
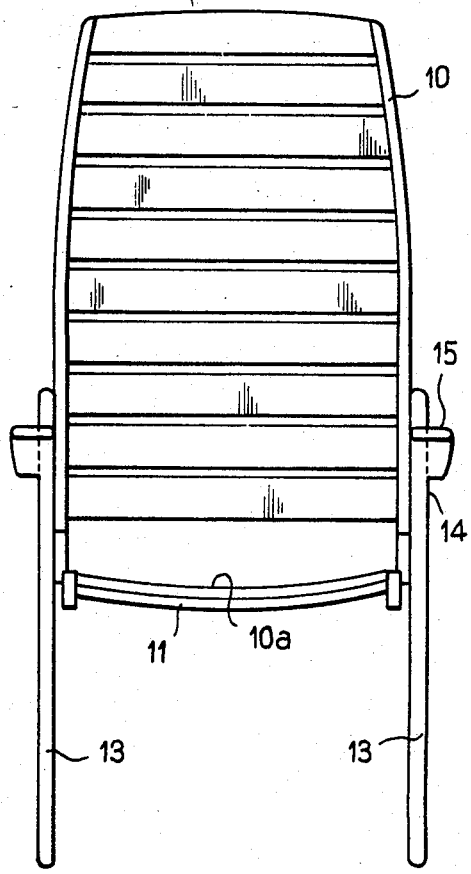
FIG_9

ARTICULATED CHAIR

This invention relates to a sitting or reclining unit, hereinafter designated as a chair, in which the different elements and in particular the back rest and chair seat are pivoted to each other about parallel axes, thus enabling the user to change from a sitting position to a reclining position.

Articulated chairs are already known in which the two positions mentioned above as well as intermediate positions between these latter can be preselected by the user.

When the chair is in use and the user desires to change position, he or she is obliged to leave the chair in order to release the locking means which set the chair in its different positions, then to displace the chair seat and back rest to the new position chosen, and then to re-set the locking means in this position.

All these handling and re-setting operations are tedious for users.

In some chair designs, the user can modify the angle of slope of the back rest by actuating a lever or a control knob.

As the back rest is tilted towards the recumbent position, the center of gravity of the user's body acts in a favorable direction, thus facilitating displacement of the back rest towards this position. However, when the user desires to change from the recumbent position to the sitting position, he or she must necessarily rise in order to restore the back rest to an upright position by reason of the fact that the center of gravity of the user's body acts in an unfavorable direction.

The aim of the present invention is to overcome the disadvantages of the designs mentioned in the foregoing by producing an articulated chair which ensures that the user is continuously permitted to modify the relative positions of the back rest and of the chair seat without being obliged to leave the chair, to lean forward or to exert considerable efforts.

The articulated chair contemplated by the invention comprises at least a back rest and a chair seat pivoted to each other about displaceable axis, the back rest being pivotally attached to a support along an axis parallel to the axis aforesaid. The back rest and the seat are continuously displaceable with respect to each other between a position in which the back rest is substantially vertical and the seat is substantially horizontal and a position in which the back rest and seat are substantially horizontal.

In accordance with a distinctive feature of the invention, at least the displacement of the chair seat is guided at the end opposite to the axis of pivotal attachment of said seat to the back rest along a curve so determined that, when the back rest and seat undergo a displacement between the two positions mentioned above, the center of gravity of the user's body moves away from a horizontal plane over a distance which is sufficiently short to ensure that the user can modify the relative position of the back rest and seat by exerting acceptable efforts on these latter without any need to rise from the chair.

Acceptable efforts are understood to mean in particular those which can be exerted by any persons including elderly persons and physically handicapped persons.

By virtue of the fact that the center of gravity of the user's body moves away from a horizontal plane only to a very slight extent, the user is thus in a condition which is very close to equilibrium in all relative positions of the back rest and of the seat. In consequence, the user need only exert a very light pressure on the seat or on the back rest in order to modify his or her position on the chair.

The chair in accordance with the invention thus ensures optimum comfort for the user.

In accordance with a preferred embodiment of the invention, the pivotal axis of the chair seat and the axis of pivotal attachment of the back rest to the seat as well as pivotal axis of the back rest are displaceable along guiding curves which are stationary with respect to the seat and so determined that the center of gravity of the chair user's body remains substantially in a horizontal plane in all the relative positions of said back rest and said seat.

In an arrangement of this type, it is possible to ensure that the center of gravity remains practically motionless, thus enabling the user to modify his or her position instantaneously without any need to exert an appreciable effort on the back rest and/or on the seat of the chair.

The curves for guiding the axis aforesaid can be defined by grooves which are stationary with respect to the chair and in which are engaged rollers attached to the opposite ends of the displaceable axes aforesaid.

In order to move from one position of the chair to another, the user need only overcome the friction forces set up by the rollers within the grooves. These friction forces can be reduced to very low valves by making use of rollers mounted on ball-bearings or anti-friction materials such as polytetrafluoroethylene.

Preferably, the chair in accordance with the invention comprises means such as clamping means which are placed within easy reach of the hands of the user who is in position on the chair and which serve to lock at least one of the articulations of the chair seat and back rest in all positions of the chair.

Other features of the invention will be more apparent upon consideration of the following description and accompanying drawings, wherein:

FIG. 7 is a schematic diagram of the chair representing the three positions mentioned above and the corresponding positions of the user and of his or her center of gravity;

FIG. 8 is a side view of an improved version of the chair in accordance with the invention;

FIG. 9 is a view of the front of the chair of FIG. 8;

The embodiment illustrated in FIGS. 1 to 7 relates to a simplified version of a chair in accordance with the invention. The chair under consideration is a garden chair of plastic material. This chair has a back rest 1, a seat 2, four legs 3, 4, the upper portion of the leg 3 being adapted to carry two arm rests 3*a*.

Figure 1:
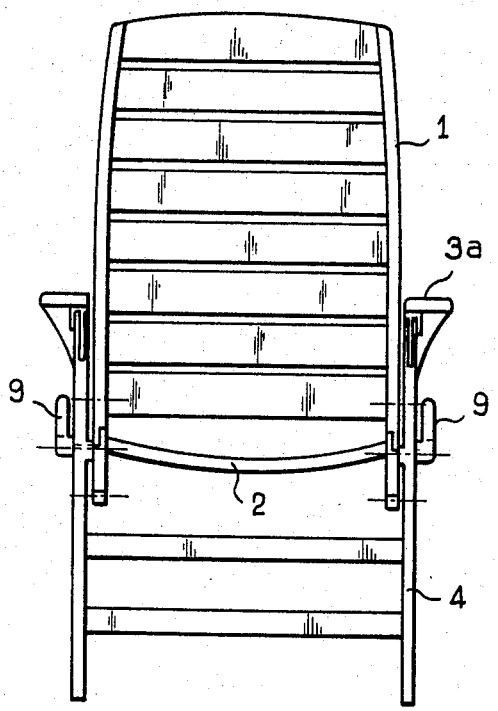
FIG. 1 is a view of the front of a chair in accordance with the invention and provided with arm rests.
Figure 2:
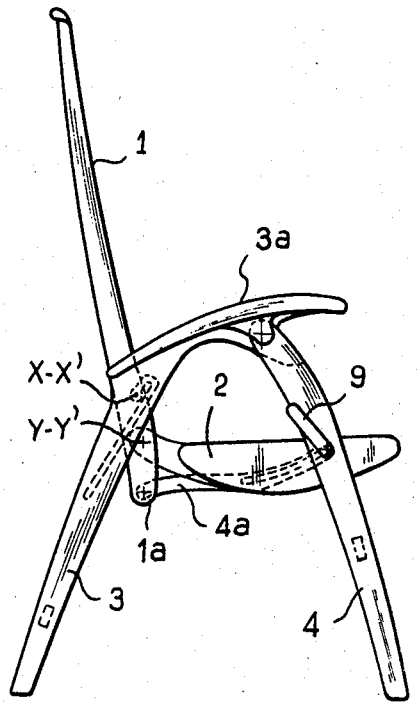
FIG. 2 is a side view of the chair.
Figure 3:
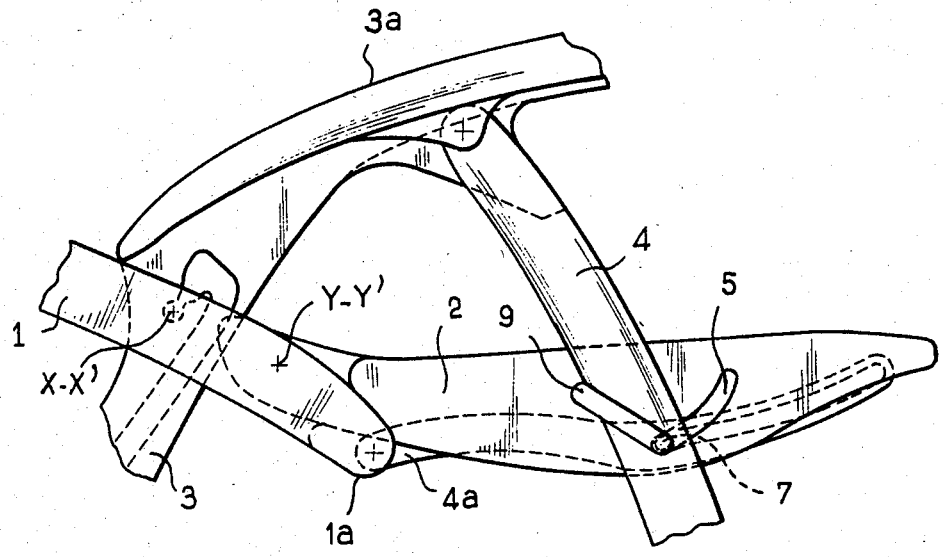
FIG. 3 is an enlarged view of a portion of the chair of FIG. 2, the back rest being in the rearwardly inclined position.
Figure 4:
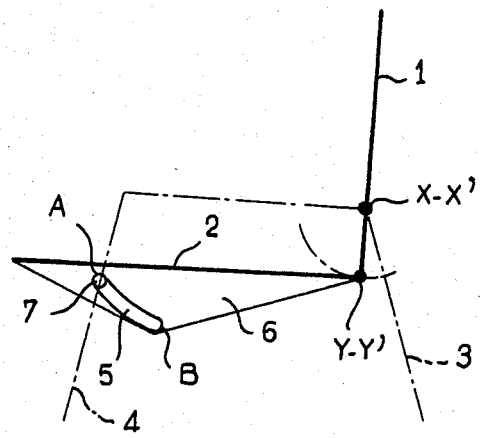
FIGS. 4 to 6 are schematic diagrams showing a chair in three different positions.

The back rest 1 is pivoted about a fixed horizontal axis X—X′ located at the upper ends of the two rear legs 3. Said back rest 1 is also pivoted to the seat 2 about a displaceable axis Y—Y′ which is parallel to the axis X—X′ aforesaid. The back rest 1 and seat 2 are continuously displaceable with respect to each other between a position corresponding to a sitting posture of the user in which the back rest is substantially vertical (as shown in FIGS. 2 and 4) whilst the seat is substantially horizontal and a recumbent posture of the user in which the back rest 1 and the seat 2 are inclined to each other at an angle of the order of 120° (as shown in FIGS. 3 and 6), thus enabling the user to lie down.

In accordance with the invention, the displacement of the seat 2 is guided at the end opposite to the axis Y—Y′ of pivotal attachment of said seat to the back rest 1 along a portion of curve A—B defined by a stationary groove 5 formed on each side of the seat 2 in side members 6 which are perpendicular to this latter. These grooves 5 are located beneath the bearing plane of the seat 2 and have an arcuate shape. The concave side of each groove 5 is directed towards the upper end of the back rest 1.

Rollers or pins 7 are engaged in said grooves 5 and are attached to each front leg 4 of the chair.

Figure 5:
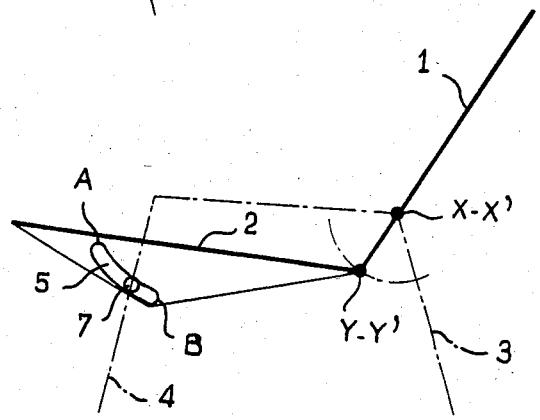
Figure 6:
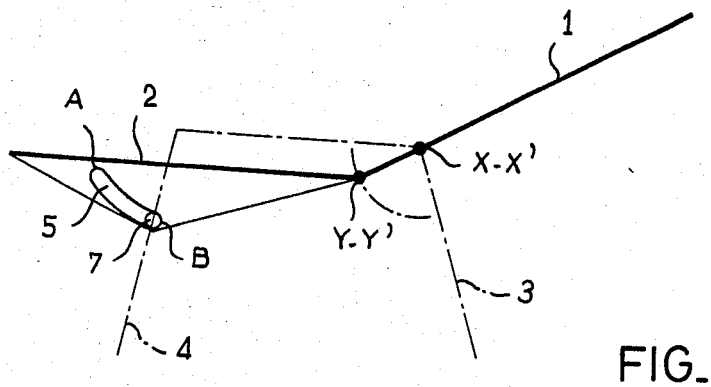
Figure 10:
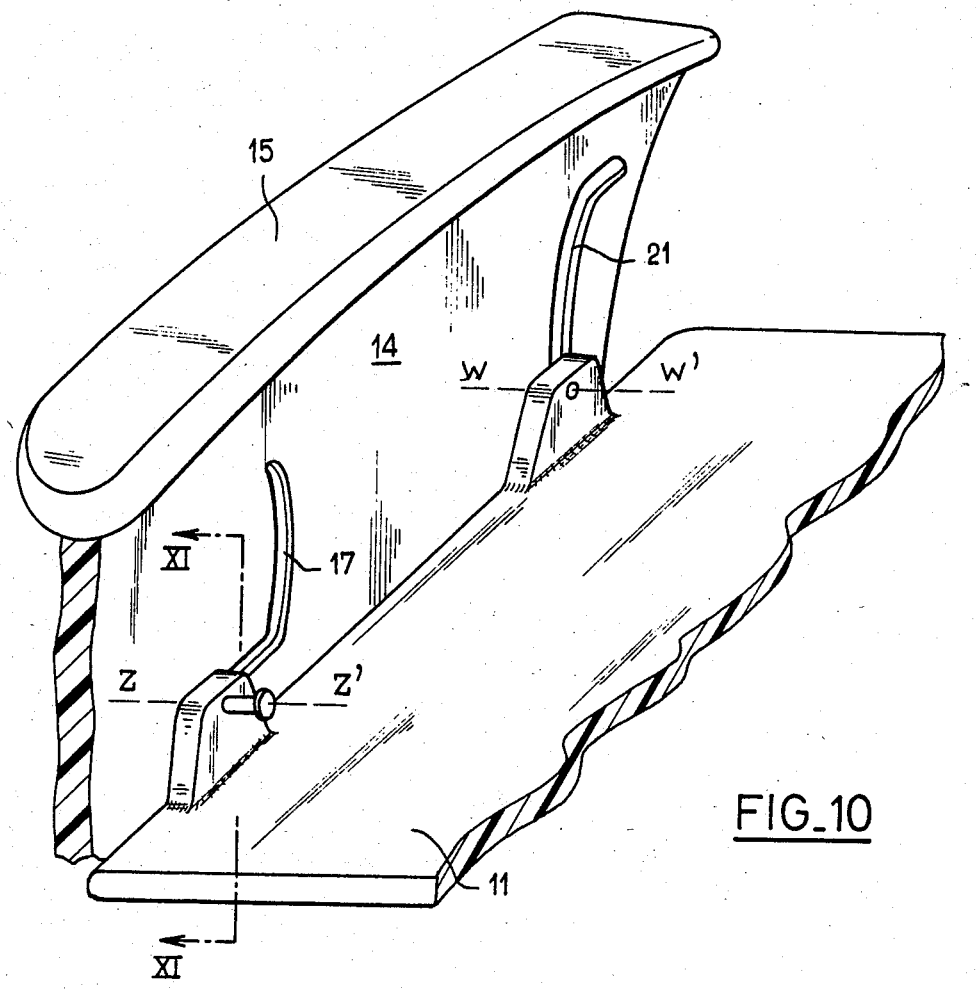
FIG. 10 is a fragmentary view in perspective of the chair and shows part of the chair seat and the attachment of the seat within the guide grooves.
Figure 11:
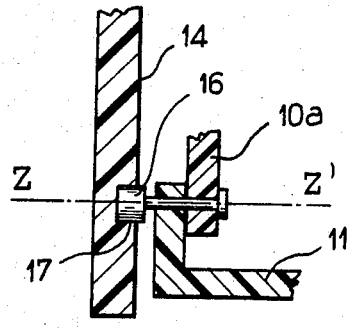
FIG. 11 is a sectional view taken along line XI—XI of FIG. 10.

The portion of curve A—B defined by each groove 5 is so determined that, when the back rest 1 and seat 2 are shifted to the different positions shown in FIGS. 5 to 6, the center of gravity (see positions $G_1$, $G_2$, $G_3$ in FIG. 7) of the user's body 8 (shown diagrammatically in chain-dotted lines in FIG. 7) moves away from a horizontal plane $H_1$ over a distance d which is sufficiently short to ensure that the efforts to be exerted by the user's body in order to change-over from one position to the other are acceptable and that the user does not need to rise from the chair in order to modify its position.

The curve A—B defined by the grooves 5 is determined empirically by defining the relative positions to be assumed by the back rest 1 and the seat 2 with a view to ensuring that the center of gravity $G_1$, $G_2$, $G_3$ moves away from the horizontal plane $H_1$ over a distance d which is as short as possible.

The back rest 1 and seat 2 can be locked in their different positions by means of clamping levers 9 which are fixed on the front legs 4 and are within easy reach of the user's hand irrespective of the user's position in the chair. These levers 9 are capable of pivotal displacement through a predetermined angle by producing action on a conventional clamping device (not shown) which prevents any displacement of the grooves 5 with respect to the stationary rollers 7. This clamping device also serves to lock the connecting arm 4*a* which is pivotally attached to the bottom edge 1*a* of the back rest 1.

The rollers 7 advantageously consist of ballbearings in order to reduce frictional contact with the grooves 5. These rollers 7 can be replaced by studs coated with antifriction material such as polytetrafluoroethylene.

The embodiment shown in FIGS. 8 to 17 relates to an improved version of a chair in accordance with the invention.

This chair comprises a back rest 10, a seat 11 and four legs 12, 13. On each side of the chair, the upper ends of the front leg 12 and of the rear leg 13 are joined together by means of a side panel 14, the top edge of which is shaped so as to form an arm rest 15.

The lowr end 10*a* of the back rest 10 is pivoted to the seat 11 about an axis Z—Z′. Rollers 16 are mounted at the opposite ends of said axis Z—Z′ and are engaged with stationary groove 17 formed in the side panels 14 (as shown in particular in FIGS. 10 and 11).

Rollers 18 are mounted at the ends of a pivotal axis V—V′ carried by the rear face of the back rest 10. The rollers are engaged within stationary grooves 19 which are also formed in the side panels 14.

At the side opposite to its rear end, the chair seat 11 is adapted to carry rollers 20 which are mounted to rotate about a pivotal axis W—W′ and are engaged within corresponding grooves 21. The grooves 17, 19 and 21 serve to guide the axes Z—Z′, V—V′ and W—W′ along portions of curves C—D, E—F, G—H which are so determined that the center of gravity of the user who is seated in the chair remains substantially in a horizontal plane in respect of all relative positions of the back rest 10 and of the chair seat 11.

These different positions are shown diagrammatically in FIGS. 12 to 17.

In these figures, it is apparent that the pivotal axis W—W′ of the chair seat 11 and the axis Z—Z′ of pivotal attachment of the seat to the back rest 10 are located substantially at the same distance above the bearing surface of the seat 11. Furthermore, the pivotal axis V—V′ of the back rest 10 is located behind the bearing surface of this latter at a distance which is closer to its lower end 10*a* than to its upper edge 10*b*.

Figure 12:
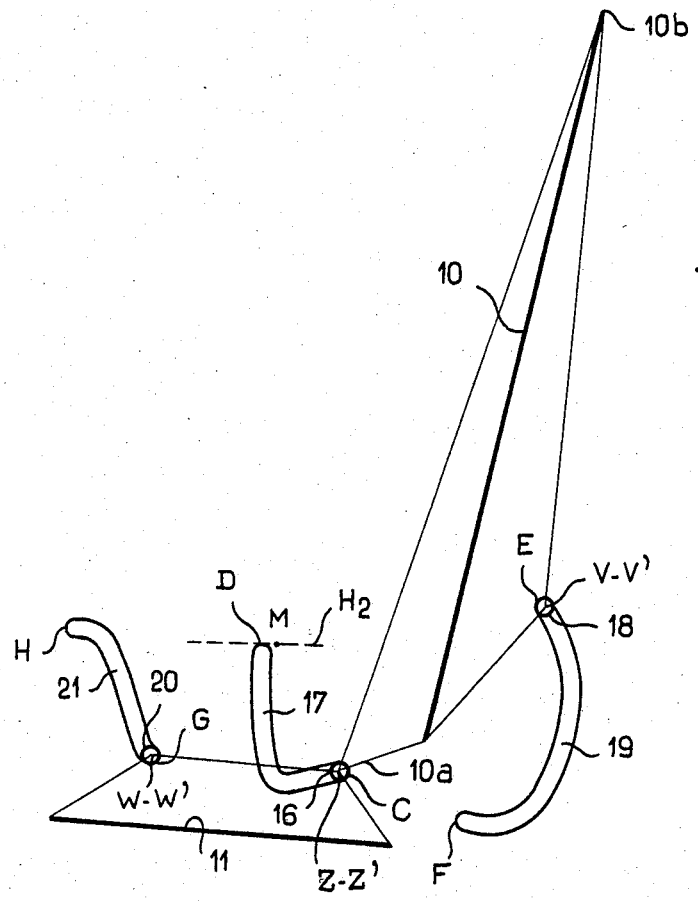
FIGS. 12 to 16 are schematic views of the improved embodiment of the chair considered above, in five different positions.
Figure 13:
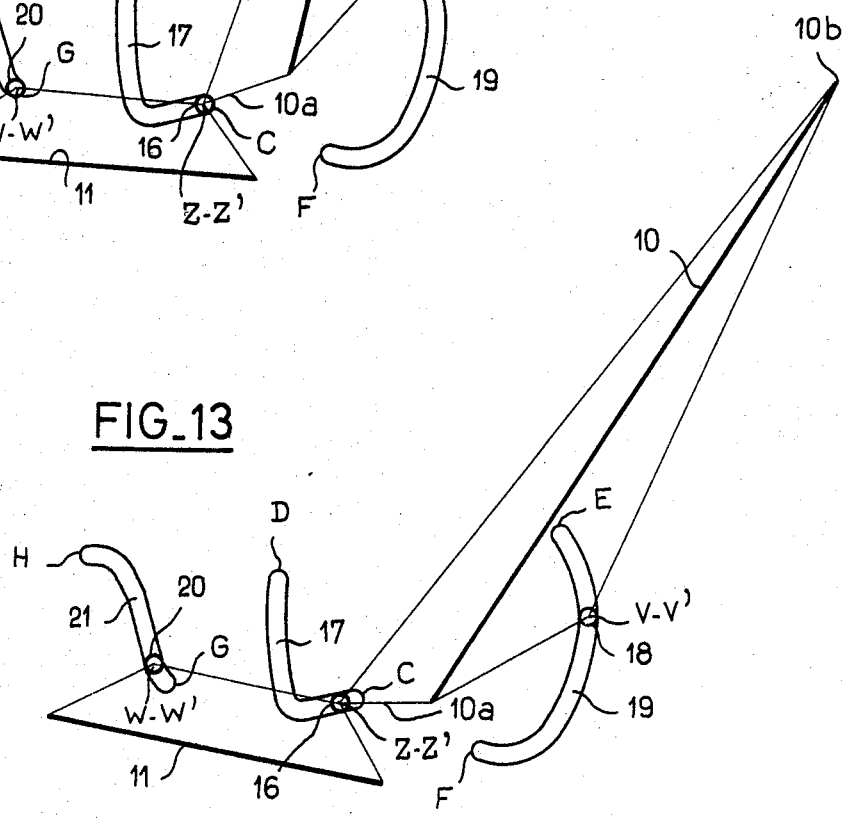
Figure 14:
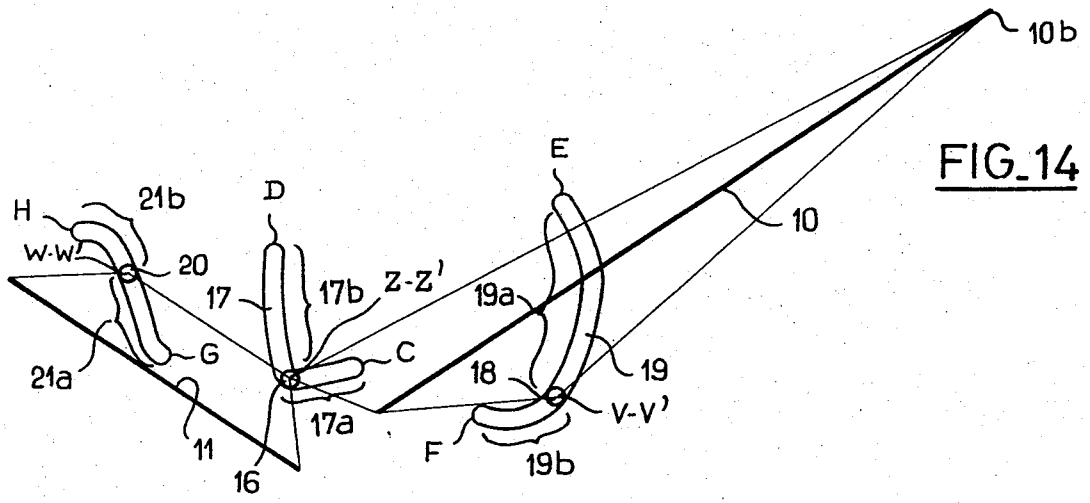

The guide grooves 17 and 21 have a first portion 17*a* and 21*a* for guiding the chair seat 11 as it is moved between a substantially horizontal position (shown in FIG. 12) and a rearwardly inclined position through an angle within the approximate range of 20° to 35° (as shown in FIGS. 13 and 14). These guide grooves 17 and 21 have a second portion 17*b* and 21*b* which permit upward displacement of the seat 11 from the position aforesaid (that shown in FIG. 14) to the practically horizontal position (shown in FIG. 16).

The guide groove 19 for the pivotal axis V—V′ of the back rest 11 has a first portion 19*a* for guiding the back rest 10 as it undergoes an angular displacement between an almost vertical position (shown in FIG. 12) and a position in which it is rearwardly inclined at an angle within the range of 110° to 120° (as shown in FIG. 14) and in which the axis Z—Z′ of pivotal attachment of the back rest 10 to the seat 11 is located at the end of the first portion 17*a* of the guide groove 17.

The guide groove 19 has a second portion 19*b* for guiding the back rest 10 as it undergoes an angular displacement towards a practically horizontal position (as shwon in FIG. 16) in which the axis Z—Z′ of pivotal attachment of the back rest 10 to the seat 11 is located at the end D of the groove 17 for guiding said axis.

In the example shown in FIGS. 8 to 16, the groove 19 for guiding the axis V—V′ of pivotal displacement of the back rest 10 extends in an arcuate curve, the concave side of which is directed towards the end D of the groove 17 for guiding the axis Z—Z′.

Furthermore, the groove 17 for guiding the axis Z—Z′ on which the back rest 10 is pivoted to the seat 11 is substantially L-shaped. One of the arms of the L corresponding to the first portion 17*a* of the guide groove 17 extends in the forward direction and has a slight downward slope. The other arm corresponding to the second portion 17*b* of the groove is directed upwards with a slight forward slope.

The groove 21 for guiding the pivotal axis W—W′ of the chair seat 11 is oriented upwards in a direction which is almost parallel to the portion 17*b* of the guide groove 17 and terminates in a forwardly directed arc corresponding to the second portion 21*b* of said groove 21.

Figure 17:
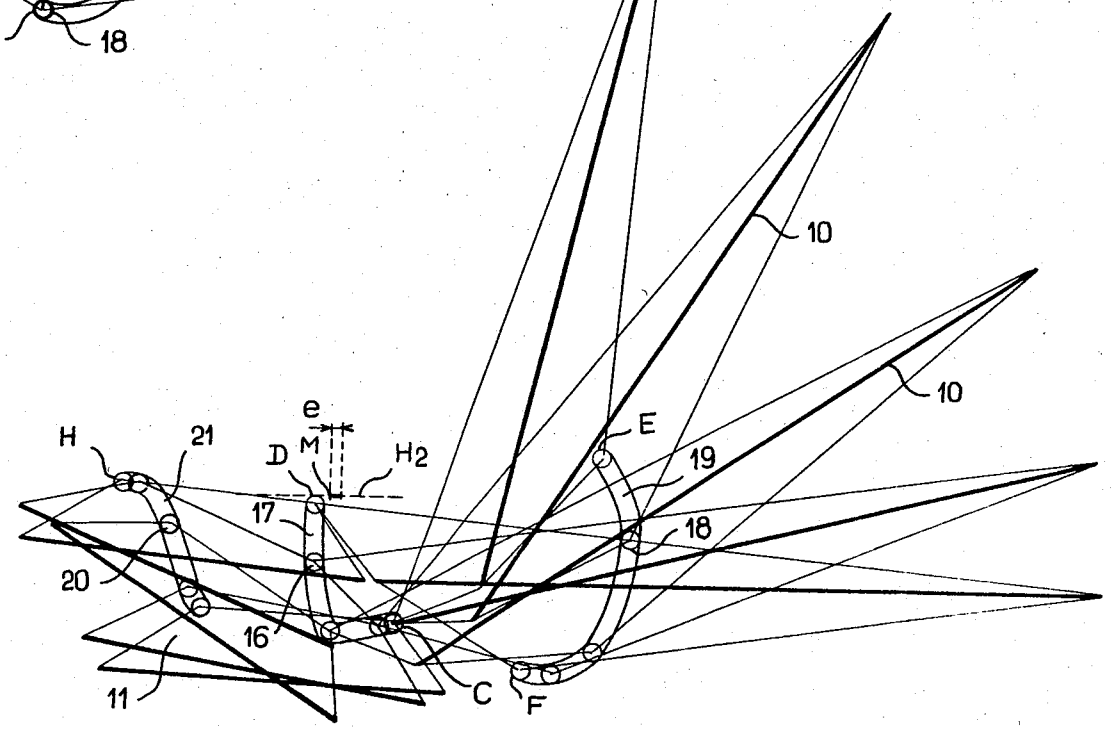
FIG. 17 is a schematic view of said chair representing the five positions mentioned above and the corresponding positions of the center of gravity of the user.

In FIG. 17, there are shown the different positions of the back rest 10 and of the chair seat 11. When the user changes-over from a sitting posture (with the back rest 10 in an almost vertical position) to a recumbent position (in which the back rest 10 is nearly horizontal), the center of gravity M of his or her body is displaced over a very short distance e in a horizontal plane $H_2$.

The result has been obtained by giving suitable shapes to the grooves 17, 19 and 21 which serve to guide the different pivotal axes of the chair, these shapes being determined by experiment or by graphical representation.

When the user places himself on the chair in a sitting posture as shown in FIG. 12, his or her center of gravity M is located near the upper end D of the groove 17 for guiding the axis Z—Z′. When the user desires to incline the back rest 10, it is only necessary for the user to release a clamping mechanism of the type described with reference to the embodiments of FIGS. 1 to 3, then to exert a light pressure against the back rest 10 with his or her back.

The center of gravity M of the user's body then tends to undergo a downward displacement towards the rear of the chair. However, by inclining the back rest 10, the front edge of the seat 11 moves upwards since it is guided by the groove 21 (as shown in FIGS. 13 and 14), with the result that the center of gravity M remains in the horizontal plane $H_2$ instead of moving downwards.

At the same time, the back rest 10 and the seat 11 move forward, with the result that the center of gravity is maintained near its initial position M as shown in FIG. 12.

Figure 15:
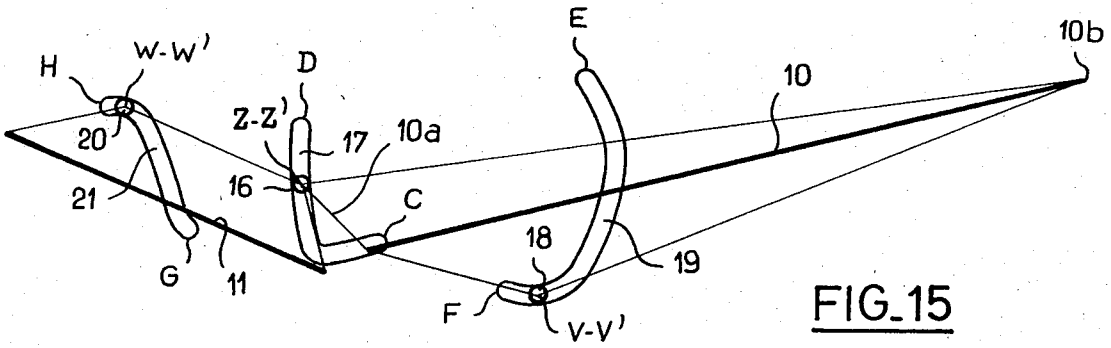
Figure 16:
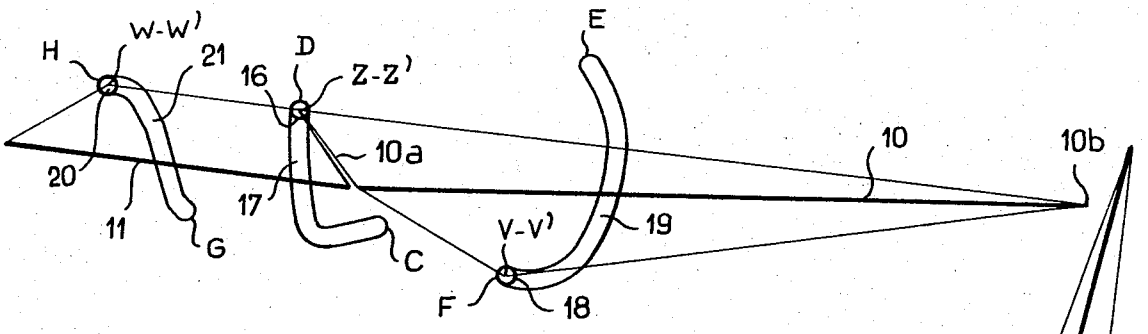

Moreover, by passing from the position shown in FIG. 14 to the positions shown in FIGS. 15 and 16, the center of gravity of the user's body tends to move downwards by reason of the increased angle of slope of the back rest 10 but this tendency is immediately compensated by an elevation, in particular of the rear of the seat 11.

Since the center of gravity M of the user's body is located in a fixed horizontal plane $H_2$ in all the relative positions of the back rest 10 and of the seat 11, the user is in a state of equilibrium in all cases. He (or she) can thus modify his position in one direction or in the other by exerting a light pressure on the back rest 10 with his back or on the chair seat 11 with his thighs. When exerting this pressure, the user must overcome solely the friction forces set up by the rollers 16, 18, 20 within the corresponding grooves 17, 19, 21. However, these friction forces can be reduced to very low values when the rollers 16, 18, 20 are replaced by ball-bearings or studs coated with an antifriction material such as polytetrafluorethylene.

Moreover, by reason of the fact that the center of gravity M of the user's body shifts over a very short distance in the horizontal plane $H_2$, the bulk of the chair is reduced to a minimum value.

Experience has also demonstrated the fact that the user's weight, size and corpulence are practically without any influence, with the result that his or her center of gravity undergoes a horizontal displacement in all cases.

Figure 18:
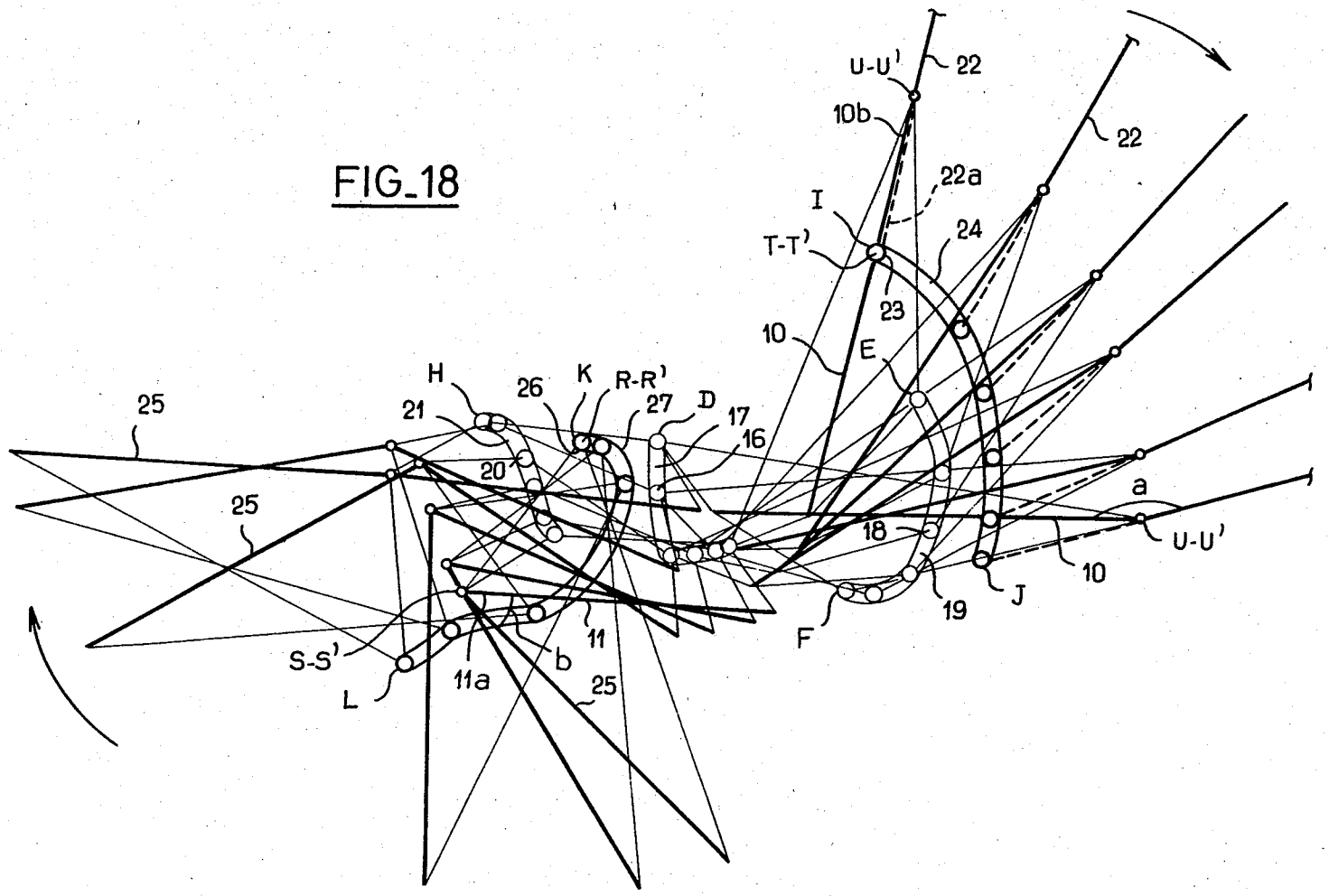
FIG. 18 is a schematic view representing the different positions of an improved chair provided with a head rest and with a foot rest.

In the embodiment of FIG. 18, there is shown diagrammatically a chair equipped with the same elements as the chair shown in FIGS. 12 to 17. These common elements are therefore designated by identical references. This chair is provided in addition with a head rest 22 which is pivoted to the top edge 10*b* of the back rest 10 about a horizontal axis U—U′. The end 22*a* of the head rest 22 which extends beyond the axis U—U′ towards the lower end of the back rest 19 has an axis T—T′ at the opposite ends of which are mounted rollers 23, said rollers being engaged with stationary arcuate grooves 24 formed in the side panels of the chair.

The end I of the arc defined by each groove 24 is located substantially in the plane of the back rest 10 in the fully raised position, said plane being thus in substantially coincident relation with the plane of the head rest 22.

The opposite end J of the groove 24 is located beneath the plane of the back rest 10 in a practically horizontal position, the angle a between the head rest 22 and the back rest 10 being distinctly smaller than 180°. In the intermediate positions, this angle decreases progressively from the most upright or fully raised position of the back rest 10, in which the angle has a value of 180°.

Said angle a is determined by the shape of the guide groove 24 for the axis T—T′.

When the user modifies the inclination of the back rest 10, the head rest 22 undergoes a progressive pivotal displacement in the forward direction. In the first place, this has the effect of lifting the user's head with respect to his or her body, thus ensuring that the head remains in a comfortable position under all conditions. Furthermore, the fact that the head is raised at the time of rearward inclination of the back rest plays a favorable role in maintaining the center of gravity of the user's body in a fixed position.

The chain shown in FIG. 18 comprises a foot rest 25 which is pivoted to the front edge 11*a* of the chair seat 11 about a horizontal axis S—S′. This foot rest 25 is held in fixed relation to a pivotal axis R—R′ which carries rollers 26, said rollers being engaged in stationary grooves 27.

The end K of each groove 27 is located substantially in the plane which passes through the ends H and D of the grooves 17 and 21 and is located substantially at equal distance from these ends H and D.

The other end L of the groove 27 is placed beneath the front end 11*a* of the seat 11 when this latter is in a practically horizontal position. By virtue of the shape of the groove 27, the angle b between the chair seat 11 and the foot rest 25 increases progressively between 30° and 180° approximately when the chair is displaced from the sitting position to the recumbent position.

The user's feet and legs take up the most comfortable position in all the different chair positions.

Moreover, the shape of the grooves 27 is so determined that the position of the user's feet and legs plays a significant part in maintaining the center of gravity of the user's body in a stationary position.

Thus in the case of the chair shown in FIG. 18, the user's feet, legs, thighs, trunk and head are in comfortable positions under all conditions and are such that the center of gravity of the entire body remains practically motionless. In consequence, the conditions of equilibrium are not liable to be disturbed by ill-suited positions of the user's legs or head which would be of a nature of produce an upward or downward displacement of the center of gravity of the body, with the result that the user would be obliged in such a case to exert a certain effort in order to compensate for this displacement of the center of gravity before being able to change the position of the chair.

As will be readily apparent, the invention is not limited to the examples described in the foregoing and a large number of modifications may accordingly be contemplated without thereby departing either from the scope or the spirit of the invention.

Thus the invention can be applied to any type of sitting or reclining accommodation such as a chair or armchair having at least a back and a seat.

Furthermore, the invention is also applicable to a long seat such as a divan-bed mattress composed of n articulated elements pivoted about n+1 parallel axes, each element being intended to serve as a support for an articulated part of the user's body such as the legs, thighs, trunk and head. The pivotal axes of these elements could be displaceable along guiding curves defined by grooves, ramps or cams so determined that the center of gravity of the user's body which is in position on these elements remains substantially in a horizontal plane in respect of all relative positions of said elements.

The user is thus permitted to modify the relative positions of these different elements by adapting them to positions which he or she desires to obtain without entailing any need to rise or to exert any excessive effort.

Furthermore, in view of the fact that the articulated elements of the chair in accordance with the invention are in substantially indifferent equilibrium, the angular displacement of the elements referred-to above between their end positions could be carried out by means of a low-power motor controlled by the user. A motor of this type would in fact be required to overcome only small and substantially constant forces in all the relative positions of the articulated elements. By way of example, this motor could thus be powered by a single dry-cell battery, which is particularly convenient, especially in the case of a garden chair.

What is claimed is:

1. An articulated chair comprising at least a back rest and a chair seat pivoted to each other about a displaceable first axis, the back rest being pivotally attached to a support about a second axis which is parallel to said first axis and is stationary with respect to the chair, said back rest and said seat being continuously displaceable with respect to each other between a position in which the back rest is substantially vertical and the seat is substantially horizontal and a position in which the back rest and the seat are substantially horizontal; the improvement wherein the displacement of the chair seat is guided at the end opposite to said first axis along a curve such that when the back rest and the seat undergo a displacement between the two said positions, the center of gravity of the chair user's body moves away from a horizontal plane over a distance which is sufficiently short to ensure that the user can modify the relative position of the back rest and of the seat by exerting acceptable efforts on those latter without any need to rise from the chair, rollers carried by a stationary part of the chair on opposite sides of the chair seat, and arcuate grooves in opposite sides of the chair seat in which said rollers roll to guide said opposite end of said chair seat along said curve.

2. In an articulated chair comprising at least a back rest and a chair seat pivoted to each other about a displaceable axis, the back rest being pivotally attached to a support along an axis parallel to said axis, said back rest and said seat being continuously displaceable with respect to each other between a position in which the back rest is substantially vertical and the seat is substantially horizontal and a position in which the back rest and the seat are substantially horizontal; the improvement in which the pivotal axis of the back rest, the axis of pivotal attachment of the back rest to the seat and the pivotal axis of said seat are displaceable along guiding curves which are stationary with respect to the seat and such that the center of gravity of the chair user's body remains substantially in a horizontal plane in all the relative positions of said back rest and of said seat, rollers disposed at opposite ends of said displaceable axes, and arcuate grooves in stationary parts of the chair in which said rollers roll to guide and axes along said curves.

3. A chair according to claim 2, wherein the pivotal axis of the seat and the axis of pivotal attachment of said seat to the back rest are located above the bearing surface of the seat and wherein the pivotal axis of the back rest is located behind the bearing surface of said back rest.

4. A chair according to claim 3, wherein said chair comprises means which are placed within easy reach of the hands of the user who is in position on the chair and which serve to lock at least one of the articulations of the chair seat or of the back rest in all positions of the chair.

5. A chair according to claim 4, wherein the curve for guiding the pivotal axis of the chair seat and the axis of pivotal attachmeent of said seat to the back rest comprises a first portion for guiding the inclination of the seat between a substantially horizontal position and a rearwardly inclined position at an angle between 20° and 35° approximately and a second portion for permitting upward displacement of the seat from the position aforesaid to a substantially horizontal position.

6. A chair according to claim 5, wherein the curve for guiding the pivotal axis of the back rest comprises a first portion for guiding the inclination of said back rest between a practically vertical position and a rearwardly inclined position at an angle between 110° and 120° approximately, in which the axis of pivotal attachment of the back rest to the seat is located at the end of the first portion of the curve which guides said axis, and a second portion for guiding the inclination of the back rest towards a nearly horizontal position in which the axis of pivotal attachment of said back rest to said seat is located at the end of the second portion of the curve which guides said axis.

7. A chair according to claim 5, wherein the curve for guiding the pivotal axis of the back rest is an arcuate curve whose concave side is directed towards the end of the curve which guides the axis of pivotal attachment of the back rest to the seat, wherein the curve for guiding the axis of pivotal attachment of the back rest to the seat has substantially the shape of an L such that one of the arms of the L-shaped curve extends towards the front and is downwardly inclined and the other arm of the L-shaped curve extends upwards, and wherein the curve for guiding the pivotal axis of the seat has a rectilinear portion which is substantially parallel to the second arm of said L-shaped guiding curve, the end of said rectilinear portion being provided with a forwardly directed arcuate portion.

8. A chair according to claim 7, wherein the end positions of the curves for guiding the different displaceable axes are so determined that the center of gravity of the chair user's body remains substantially stationary in all the relative positions of the back rest and of the seat.

9. A chair according to claim 8 and further comprising a heat rest pivoted to the top edge of the back rest about an upper axis, wherein said head rest has a lower pivotal axis which is parallel to said upper axis and displaceable along a guiding curve so determined that the center of gravity of the user's body remains substantially in a horizontal plane in all the relative positions of the head rest, of the back rest, and of the seat.

10. A chair according to claim 9 and further comprising a foot rest pivoted to the front end of the seat about a lower axis, wherein the foot rest has an upper pivotal axis which is parallel to said lower axis and is displaceable along a guiding curve so determined that the center of gravity of the user's body remains substantially in a horizontal plane in all the relative positions of the foot rest, of the back rest, and of the seat.

* * * * *